US011650530B2

(12) United States Patent
Kawamura et al.

(10) Patent No.: US 11,650,530 B2
(45) Date of Patent: May 16, 2023

(54) SYSTEM, SYSTEM CONTROL METHOD, AND STORAGE MEDIUM FOR RECEIVING INPUT TO IMPROVE A DEFECT OF A PRINTED IMAGE

(71) Applicant: CANON KABUSHIKI KAISHA, Tokyo (JP)

(72) Inventors: Nobuhiro Kawamura, Nagareyama (JP); Hiroya Igarashi, Toride (JP); Toru Shinnae, Kashiwa (JP); Satoshi Yoshida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/994,028

(22) Filed: Aug. 14, 2020

(65) Prior Publication Data

US 2021/0063933 A1 Mar. 4, 2021

(30) Foreign Application Priority Data

Aug. 30, 2019 (JP) ..... JP2019-158667

(51) Int. Cl.
*G03G 15/00* (2006.01)

(52) U.S. Cl.
CPC ..... *G03G 15/5016* (2013.01); *G03G 15/5029* (2013.01); *G03G 15/5037* (2013.01); *G03G 15/55* (2013.01)

(58) Field of Classification Search
CPC ..... G03G 15/5037
See application file for complete search history.

(56) References Cited

U.S. PATENT DOCUMENTS

2003/0222905 A1* 12/2003 Wierenga ..... G05B 19/42 715/744
2007/0237529 A1* 10/2007 Katou ..... G03G 15/55 399/9
2012/0197455 A1* 8/2012 Lee ..... H02J 3/008 700/295
2013/0141738 A1* 6/2013 Shibata ..... H04N 1/0044 358/1.2
2014/0160526 A1* 6/2014 Shinagawa ..... G03G 15/5025 358/1.15
2015/0185678 A1* 7/2015 Yoshida ..... G03G 15/0105 399/341
2017/0264761 A1* 9/2017 Kuwahara ..... H04N 1/00411

FOREIGN PATENT DOCUMENTS

JP 2007-281742 A 10/2007

OTHER PUBLICATIONS

JP_2007281742_A_T MachineTranslation, Japan, Oct. 2007, Kato.*

* cited by examiner

*Primary Examiner* — Victor Verbitsky
(74) *Attorney, Agent, or Firm* — Canon U.S.A., Inc. I.P. Division

(57) ABSTRACT

A system displays a plurality of display objects respectively corresponding to a plurality of symptoms of an image forming apparatus, receives a selection of one display object from among the plurality of display objects, and displays a screen for receiving, from a user, a value related to a predetermined item to be adjusted to improve a symptom corresponding to the selected display object.

7 Claims, 12 Drawing Sheets

FIG.7

701

| SHEET ID | SHEET NAME | BASIS WEIGHT | SIZE | WIDTH | HEIGHT | SURFACE PROPERTIES | SHEET CONVEYANCE OF FIRST FIXING PORTION | SHEET CONVEYANCE OF SECOND FIXING PORTION | . . . |
|---|---|---|---|---|---|---|---|---|---|
| 1 | SHEET A | 216 | A4 | 297 | 210 | HIGH-QUALITY PAPER | 0 | 0 | . . . |
| 2 | SHEET B | 148 | A4 | 297 | 210 | HIGH-QUALITY PAPER | -1 | 0 | . . . |
| 3 | SHEET C | 90 | 11 x 17 | 279.4 | 431.8 | RECYCLED PAPER | 0 | 1 | . . . |
| 4 | SHEET D | 90 | A3 | 297 | 420 | MATTE COATED PAPER | -10 | 0 | . . . |
| 5 | SHEET E | 350 | A3 | 297 | 420 | EMBOSSED PAPER | 0 | 2 | . . . |
| . . . | . . . | . . . | . . . | . . . | . . . | . . . | . . . | . . . | . . . |

FIG.11

1100

| IMAGE ID (1101) | ADJUSTMENT ITEM (1102) | MESSAGE (1103) | CHART TYPE (1104) | NUMBER OF OUTPUT SHEETS (1105) |
|---|---|---|---|---|
| Img1 | SHEET CONVEYANCE OF FIRST FIXING PORTION | "Msg1" | C255, M255 | 1 |
| Img2 | SHEET CONVEYANCE OF FIRST FIXING PORTION | "Msg1" | K128 | 1 |
| Img3 | SHEET CONVEYANCE OF SECOND FIXING PORTION | "Msg3" | C255, M255 | 2 |
| Img4 | SHEET CONVEYANCE OF REVERSE DISCHARGE PORTION | "Msg4" | GRID | 1 |
| . . . | . . . | | | |
| Img13 | SHEET CONVEYANCE OF FIRST FIXING PORTION | "Msg2" | M128 | 1 |

SYSTEM, SYSTEM CONTROL METHOD, AND STORAGE MEDIUM FOR RECEIVING INPUT TO IMPROVE A DEFECT OF A PRINTED IMAGE

BACKGROUND

Field of the Disclosure

The present disclosure relates to a system, a system control method, and a storage medium.

Description of the Related Art

In the production printing market, an image forming apparatus capable of treating various types of sheets, such as thin paper, thick paper, coated paper, and a film, is used. In such an image forming apparatus, various pieces of sheet information, such as a name, a size, and a basis weight, are given to identify the type of each sheet. The sheets can be managed using a sheet list, and settings for the sheets to be fed to each sheet feeding stage can be made.

The sheet information includes attributes, such as a name, a size, a basis weight, and adjustment attributes. The adjustment attributes include adjustment values for a transfer voltage and an image position that enable printing under optimum conditions for the sheets with a high image quality and high printing accuracy. Since there is a wide variety of items to be adjusted, it may take time and effort to set an optimum value for a target adjustment item. Such a setting operation may include identifying items to be adjusted based on a symptom related to an image defect occurring in a printed material, adjusting and repeating test printing, and continuing until the symptom disappears. It takes time and effort for the adjustment of setting values for the respective adjustment items, which may place a great burden on an operator.

Japanese Patent Application Laid-Open No. 2007-281742 discusses a technique for simulating image defects, which may occur when a defect occurs in a component constituting an image forming apparatus, in various adjustment items, and displaying the image defects as assumed images.

The technique discussed in Japanese Patent Application Laid-Open No. 2007-281742 is effective to identify the component in which a defect occurs and to replace the component with another one, but knowing how to adjust values to fix a possible defect is not addressed.

SUMMARY

According to an aspect of the present disclosure, a system includes a display control unit configured to cause a display unit to display a plurality of display objects respectively corresponding to a plurality of symptoms of an image forming apparatus, and a selection unit configured to select one display object from among the plurality of display objects displayed by the display unit. The display unit is caused to display a screen for receiving, from a user, a value related to a predetermined item to be adjusted to improve a symptom corresponding to the display object selected by the selection unit.

Further features of the present disclosure will become apparent from the following description of exemplary embodiments with reference to the attached drawings.

BRIEF DESCRIPTION OF THE DRAWINGS

FIG. 7 illustrates an example of a sheet setting management table included in the print control device according to the first exemplary embodiment.

FIG. 11 illustrates an example of an adjustment screen management table included in the print control device according to the first exemplary embodiment.

DESCRIPTION OF THE EMBODIMENTS

Exemplary embodiments of the present disclosure will be described in detail below with reference to the accompanying drawings.

Figure 1:
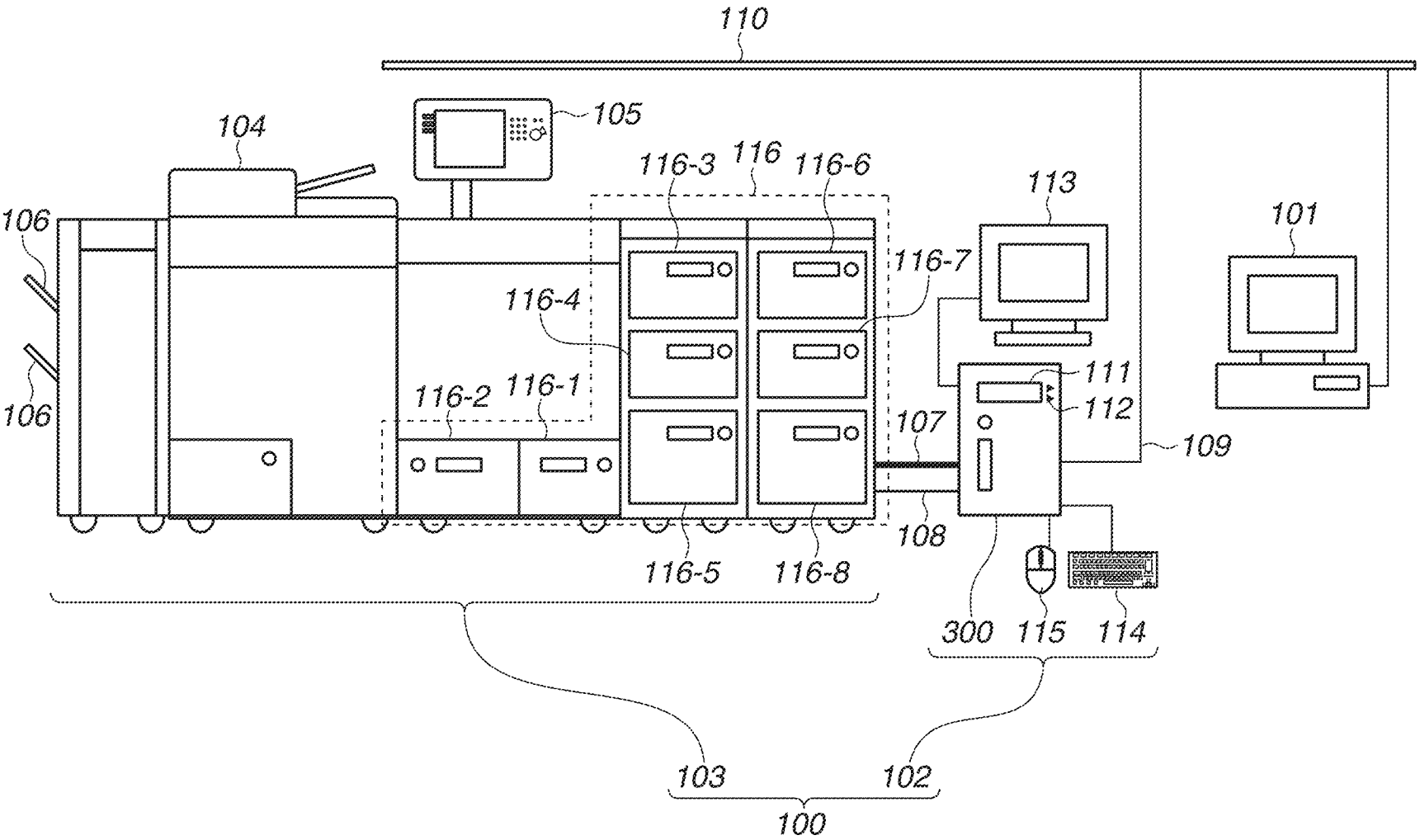
FIG. 1 is a block diagram illustrating an example of an overall configuration of a print system according to a first exemplary embodiment.

FIG. 1 is a block diagram illustrating an overall configuration of a print system 100 according to a first exemplary embodiment.

The print system 100 includes an image forming apparatus 103, and a print control device 102. The print system 100 is communicably connected to a client computer 101. The client computer 101 and the print control device 102 are communicably connected via a local area network (LAN) 110 with an Ethernet® cable 109. The print control device 102 and the image forming apparatus 103 are connected via an image video cable 107 and a control cable 108. In the present exemplary embodiment, the image forming apparatus 103 is not directly connected to the LAN 110. The image forming apparatus 103 and the client computer 101 communicate with each other via the print control device 102. The image forming apparatus 103 may be connected to the LAN 110. In other words, the image forming apparatus 103 may be connected to the client computer 101 to directly communicate with the client computer 101. The client computer 101 activates an application program, for example, to send a print instruction to the print system 100. The print control device 102 performs image processing in cooperation with the image forming apparatus 103.

The image forming apparatus 103 is a multi-function peripheral including various functions. The image forming apparatus 103 is configured not only to perform image processing based on instructions from the client computer 101 and the print control device 102, but also to copy data scanned by a scanner unit 104 and transmit the data to a shared folder. When the scanner unit 104 scans an image, an operation panel 105 receives various instructions from a user through various keys. The operation panel 105 displays various information, such as a scanning state, through a panel. A sheet discharge portion 106 receives a sheet on which an image is formed, and discharges the received sheet.

The print control device 102 includes a controller 300 and a display unit 111. On the display unit 111, information on the print control device 102 is displayed. The user operates a hardware operation button unit 112 of the print control device 102 to manipulate information displayed on the display unit 111. The information displayed on the display unit 111 is used to display minimum required information (power supply operation and checking of an internet protocol (IP) address) for operating the print control device 102. The print control device 102 is further connected with an external display device 113, a keyboard 114, and a pointing device 115. The first exemplary embodiment illustrates an example of the print system 100 in which the print control device 102 and the image forming apparatus 103 are provided as separate systems. However, the processing of the print control device 102 may be included in the image forming apparatus 103, and thus the print control device 102 may not be physically separated. The external display device 113 may include a position input device function, such as a touch pad, and may also have a function of the pointing device 115.

Sheet feeding units 116-1 to 116-8 (which may be collectively referred to as a sheet feeding portion 116) connected to the image forming apparatus 103 are configured to store printing sheets. When a print instruction is received, one of sheet feeding stages is selected and a sheet is fed from the selected sheet feeding stage. A number of sheet feeding units 116 is increased/decreased depending on a configuration of optional devises connected to the image forming apparatus 103.

Figure 2:
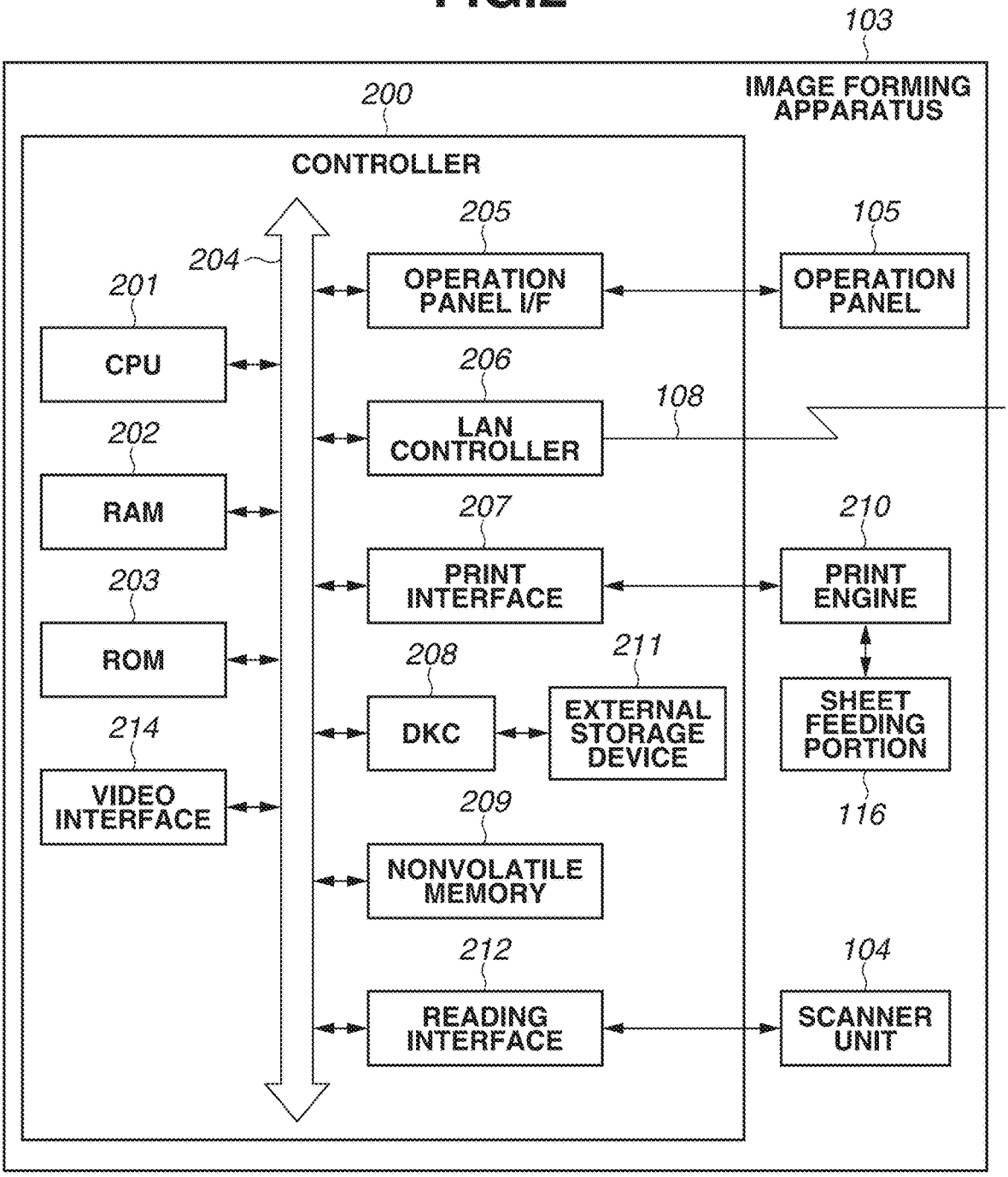
FIG. 2 is a block diagram illustrating an example of a hardware configuration of an image forming apparatus according to the first exemplary embodiment.

FIG. 2 is a block diagram illustrating a hardware configuration of the image forming apparatus 103 according to the first exemplary embodiment.

A controller 200 includes a central processing unit (CPU) 201. The CPU 201 loads control programs stored in a read-only memory (ROM) 203 or an external storage device 211 into a random access memory (RAM) 202, and executes the loaded programs thereby to control an overall operation of various devices connected to a system bus 204. The CPU 201 outputs an image signal as output information to a print unit (print engine) 210 connected via a print interface 207, and receives an image signal input from the scanner unit 104 connected via a reading interface 212. The CPU 201 controls the sheet feeding portion 116 connected to the print engine 210 via the print interface 207, and acquires a state of the sheet feeding portion 116. The CPU 201 can also perform communication processing with the print control device 102 via a LAN controller 206 and the control cable 108. The RAM 202 mainly functions as a main memory and a work area for the CPU 201. The external storage device 211, such as a hard disk drive (HDD), and an integrated circuit (IC) card, is controlled for accessing by a disk controller (DKC) 208. The HDD is used as a job storage area for storing application programs, font data, form data, and other data, temporarily spooling print jobs, and externally controlling the spooled jobs. The HDD is also used as a BOX data storage area for storing image data input from the scanner unit 104 or image data for print jobs as BOX data, referring to the image data from the network, and performing printing. In the first exemplary embodiment, the HDD can be used as an example of the external storage device 211, and the HDD stores various logs, such as a job log, and an image log. The external storage device 211 may be, for example, a solid state drive (SSD). The operation panel 105 is connected to the controller 200 via an operation panel interface 205, and thereby the user can input various information via software keys or hardware keys. A nonvolatile memory 209 stores various setting information set with a terminal via the LAN 110 or the operation panel 105. A video interface 214 receives image data from the print control device 102.

Figure 3A:
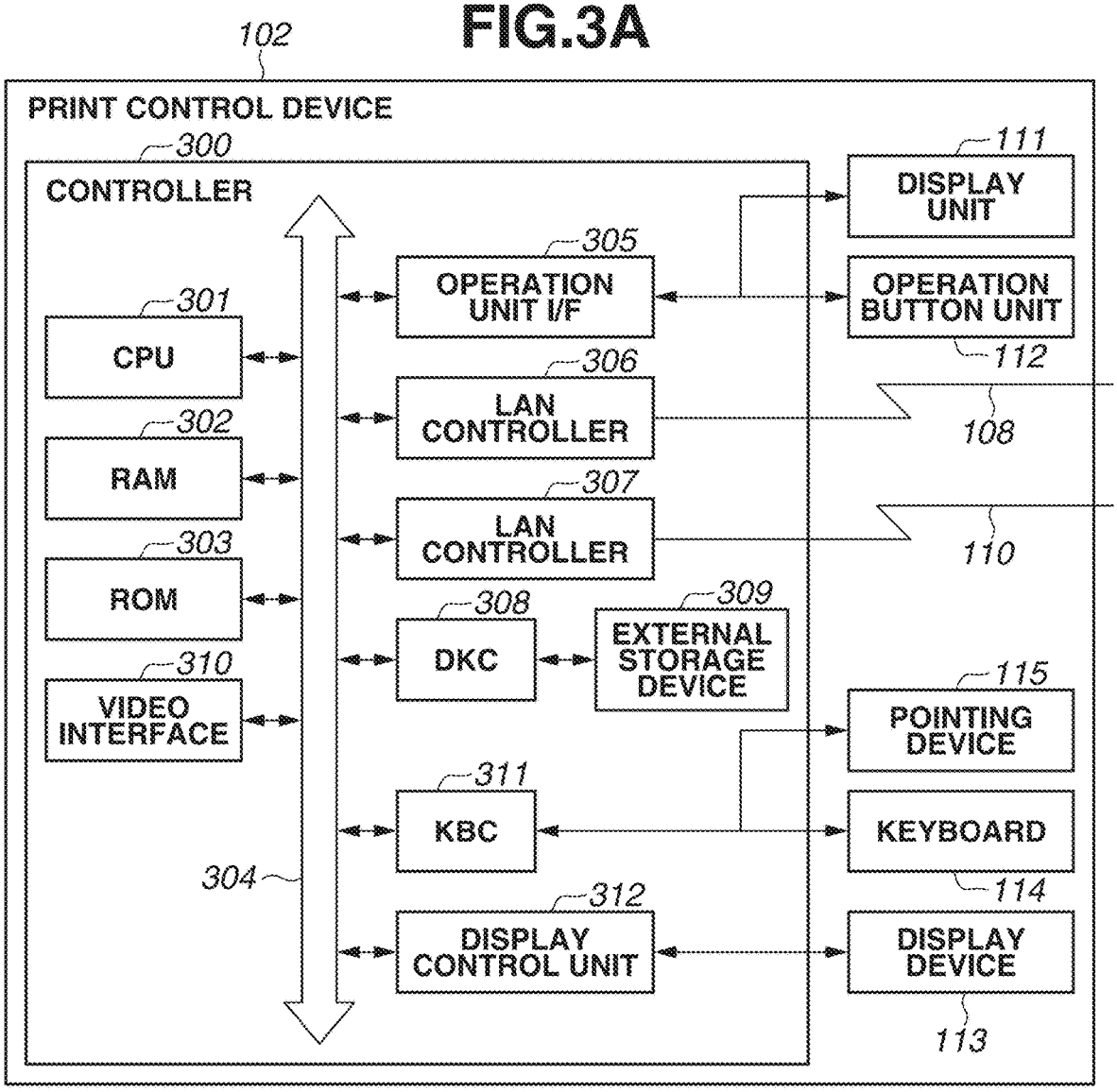
FIG. 3A is a block diagram illustrating an example of a hardware configuration of a print control device according to the first exemplary embodiment.

FIG. 3A is a block diagram illustrating a hardware configuration of the print control device 102 according to the first exemplary embodiment.

The controller 300 includes a CPU 301. The CPU 301 loads control programs stored in a ROM 303 or an external storage device 309 into a RAM 302, and executes the loaded programs thereby to control an overall operation of various devices connected to a system bus 304. The CPU 301 can communicate with the image forming apparatus 103 via a LAN controller 306 and the control cable 108. The CPU 301 can also perform communication processing with the client computer 101 and the image forming apparatus 103 via a LAN controller 307 and the LAN 110. The RAM 302 mainly functions as a main memory and a work area for the CPU 301. The external storage device 309, such as an HDD, and an IC card, is controlled for accessing by a DKC 308. The HDD stores, for example, application programs, font data, and form data, and temporarily spools print jobs. The HDD is also used as a job storage area for performing raster image processor (RIP) processing on the spooled jobs and storing the processed jobs again. An operation unit interface 305 controls an interface between the controller 300 and each of the operation button unit 112 and the display unit 111. The user uses the operation button unit 112 to input various information. The display unit 111 presents information to the user. A video interface 310 transmits RIP processed image data to the image forming apparatus 103. A keyboard controller (KBC) 311 performs processing related to an input, such as information received from the keyboard 114 or the pointing device 115. A display control unit 312 includes a video memory. The display control unit 312 renders data in the video memory based on an instruction from the CPU 301, and outputs image data rendered in the video memory as a video signal to the display device 113.

Figure 3B:
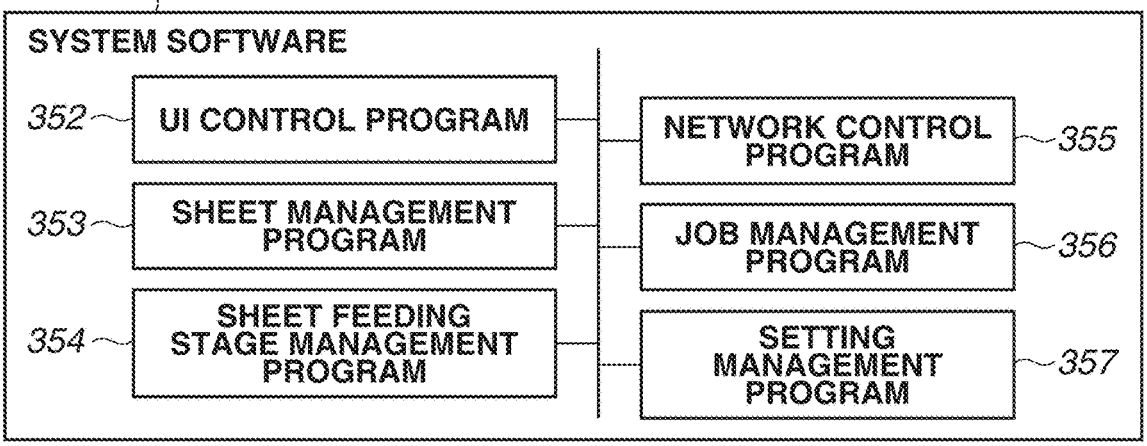
FIG. 3B is a block diagram illustrating an example of a software configuration of the print control device according to the first exemplary embodiment.

FIG. 3B is a block diagram illustrating a configuration of a software included in the print control device 102 according to the first exemplary embodiment. Functions of each unit illustrated in FIG. 3B are achieved by the CPU 301 executing the programs loaded into the RAM 302.

A system software 351 for controlling the print control device 102 includes a user interface (UI) control program 352, a sheet management program 353, a sheet feeding stage management program 354, a network control program 355, a job management program 356, and a setting management program 357. The UI control program 352 controls a screen displayed on the print system 100. The UI control program 352 controls switching of a display of a display unit system for a message or a sheet size to be displayed on the screen based on the settings in the print system 100. The sheet management program 353 communicates with the image forming apparatus 103 to manage the acquired sheet information using a sheet setting management table 700 illustrated in FIG. 7.

The network control program 355 controls the communication with the image forming apparatus 103 via the LAN controller 306. The network control program 355 also controls the communication with the client computer 101 located on the LAN 110 via the LAN controller 307. The job management program 356 manages a print processing sequence and an order of jobs. The job management program 356 also manages jobs received by the print control device 102, and controls data transfer for printing the received jobs to the image forming apparatus 103 via the LAN controller 306 or the video interface 310. The setting management program 357 manages system settings for a sheet management system. Examples of the system settings include a language setting for messages to be displayed on the screen of the sheet management system, and a setting for the display unit system (millimeter or inch) for a sheet size, as indicated in a setting screen 800 described below.

Figure 4:
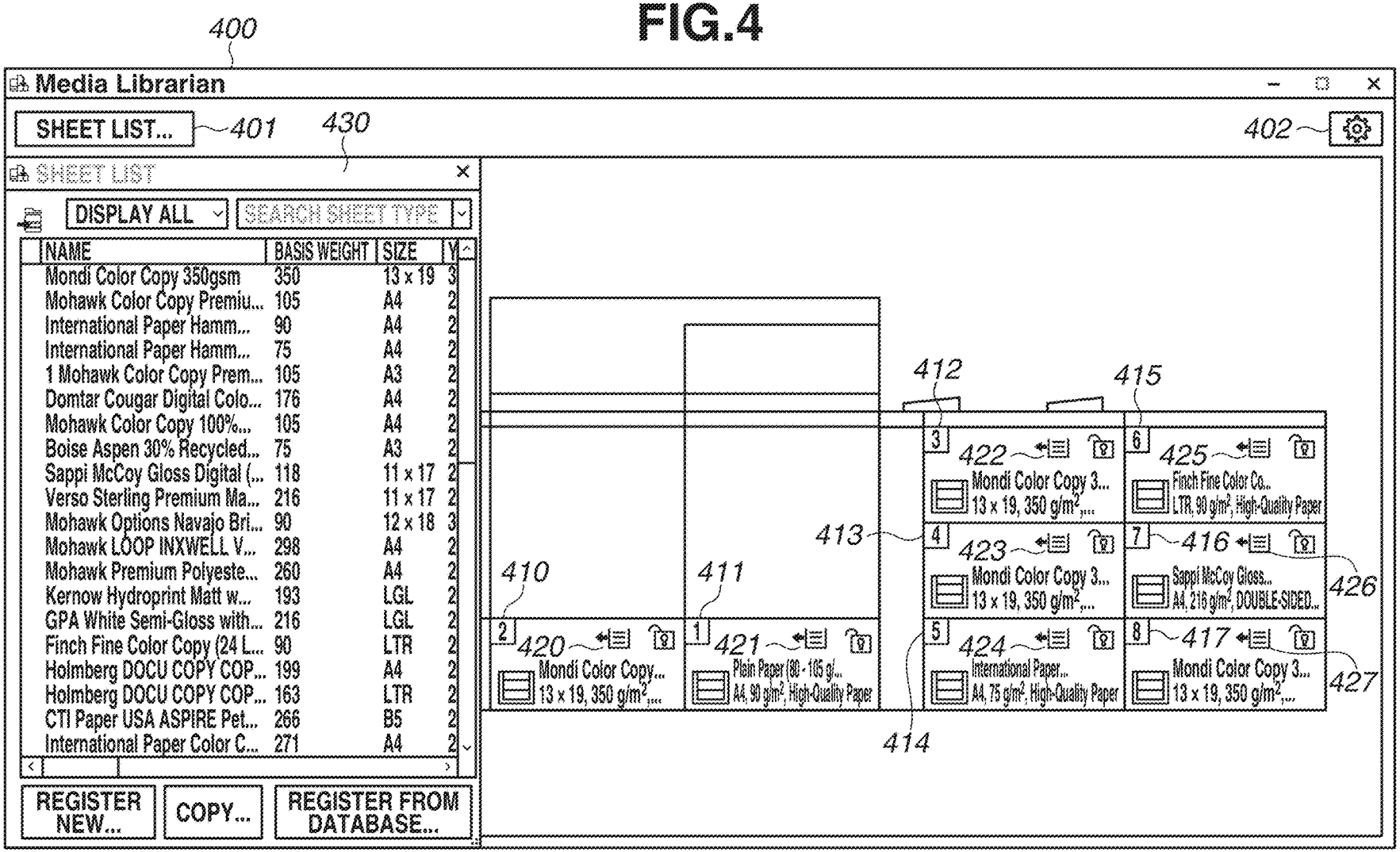
FIG. 4 illustrates an example of a top screen for a sheet management application to be executed by the print control device according to the first exemplary embodiment.

FIG. 4 illustrates an example of a top screen 400 for a sheet management application to be executed by the print control device 102 according to the first exemplary embodiment.

The top screen 400 is a screen example in a state where information about the sheet feeding stages of the image forming apparatus 103 connected to the print control device 102 is displayed. On the top screen 400, image data is rendered in the video memory based on an instruction from the CPU 301, and the image data rendered in the video memory is output as a video signal to the display device 113 and is displayed on the display device 113.

When the sheet management application is activated, the sheet management application acquires device configuration information about the image forming apparatus 103 and displays an appropriate image based on option information included in the acquired device configuration information. FIG. 4 illustrates a state where eight sheet feeding stages are connected. Sheet feeding stage buttons 410 to 417 correspond to each of the sheet feeding stages. Sheet feeding portion open buttons 420 to 427 are buttons for instructing to open the respective sheet feeding stages. Specifically, a sheet feeding stage opens when a corresponding sheet feeding portion open button is pressed while the sheet feeding stage is closed. The sheet management application creates and displays the sheet feeding stage buttons based on information about the sheet feeding stages (sheet feeding stage information) of the image forming apparatus 103, the information having been acquired at the start-up time of. Each sheet feeding stage button includes an area for displaying information, such as a sheet name, and the remaining number of sheets that are set for each sheet feeding stage. When the state of each sheet feeding state is changed by the image forming apparatus 103 and a sheet feeding stage state change event is received from the image forming apparatus 103, the controller 300 acquires the sheet feeding stage information again. The controller 300 renders data again in a display area of the sheet feeding stage button based on the acquired sheet feeding stage information.

A sheet list button 401 is used for instructing to display a sheet list screen 430. When the sheet list button 401 is pressed, the controller 300 according to the first exemplary embodiment displays the sheet list screen 430 on the frontmost surface of the screen.

A setting button 402 is used for instructing to display a screen for changing the system settings of the sheet management application. When the setting button 402 is pressed, the controller 300 displays the current system settings based on the system settings stored in the external storage device 309.

Figure 5:
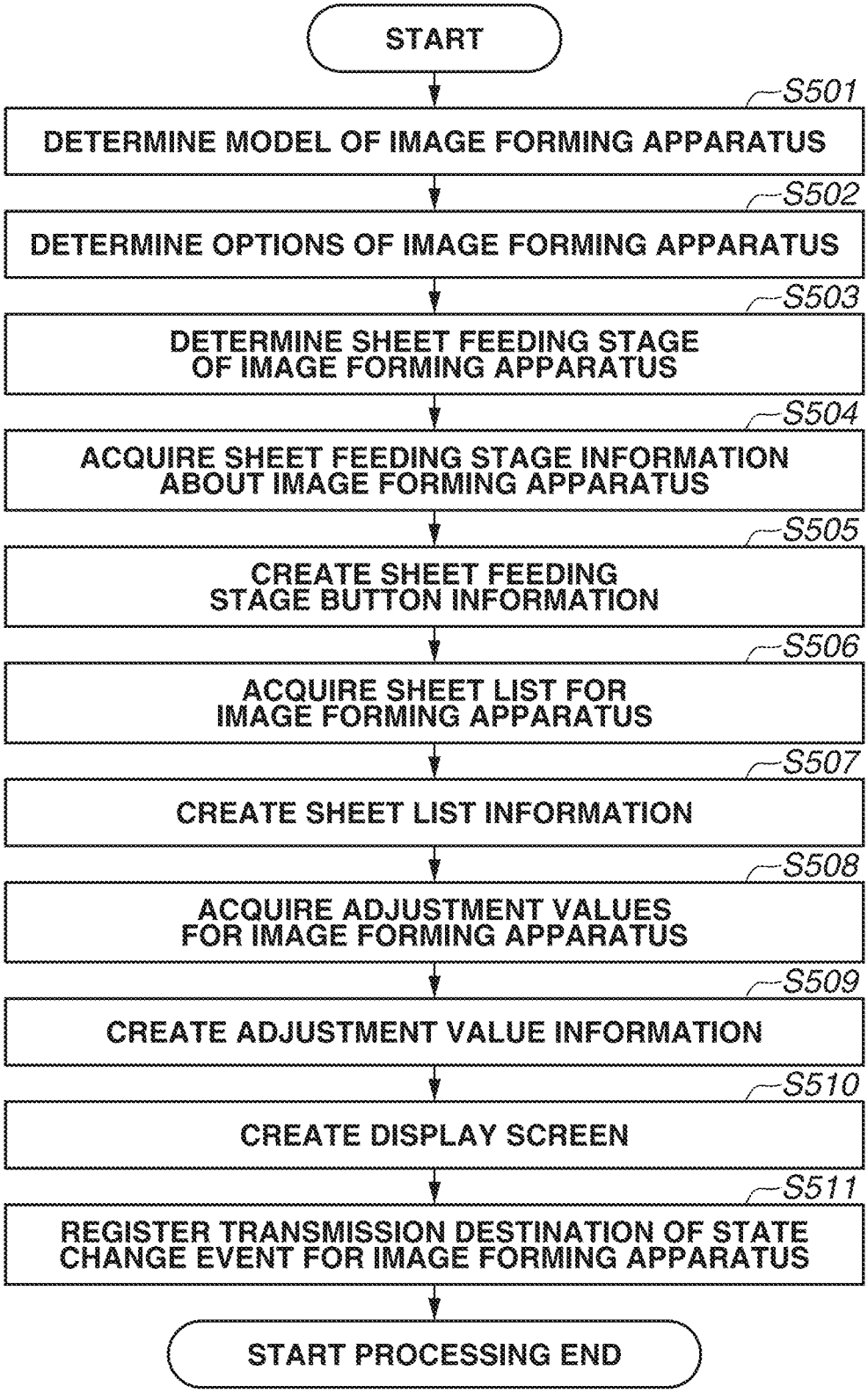
FIG. 5 is a flowchart illustrating an example of processing for generating the top screen when the sheet management application is activated by the print control device according to the first exemplary embodiment.

FIG. 5 is a flowchart illustrating processing for creating top screen 400 when the sheet management application is activated by the print control device 102 according to the first exemplary embodiment. The sheet management application according to the first exemplary embodiment is operated on the print control device 102, but instead can be operated on, for example, the client computer 101 in a same manner. In the present exemplary embodiment, there is an example described where the print control device 102 executes the sheet management application. The processing illustrated in this flowchart is achieved by the CPU 301 executing the programs loaded in the RAM 302 as described above.

This processing starts when the print control device 102 is activated. In step S501, the CPU 301 determines a model of the image forming apparatus 103 connected as a sheet management target. The CPU 301 determines the model of the image forming apparatus 103 and uses the determination result to create a device configuration screen for the top screen 400, or to absorb specifications differences between models. In this case, the CPU 301 communicates with the image forming apparatus 103 and acquires model information from the information sent from the image forming apparatus 103 in step S607 illustrated in FIG. 6 described below. The CPU 301 further determines the model of the image forming apparatus 103 based on model determination information held in advance. After the model of the connected image forming apparatus 103 is determined, the processing proceeds to step S502. In step S502, the CPU 301 communicates with the image forming apparatus 103 and acquires device configuration information about the image forming apparatus 103 from the information sent in step S609 illustrated in FIG. 6. The CPU 301 then determines the configuration of each device connected to the image forming apparatus 103. The CPU 301 uses the determination result when the CPU 301 creates the device configuration screen on the top screen 400, identifies information about each sheet feeding stage, or absorbs specifications differences between models.

In step S503, the CPU 301 acquires sheet feeding stage information about the image forming apparatus 103 from the image forming apparatus 103. The sheet feeding stage information includes information about the configuration of each sheet feeding stage, such as a sheet feeding stage, a manual feed tray, and a long sheet tray, and information about sheets set for each sheet feeding stage. Further, the CPU 301 determines the sheet feeding stages connected to the image forming apparatus 103 as the sheet management target, and specifies a number of the connected sheet feeding stages. In step S504, the CPU 301 communicates with the image forming apparatus 103. Further, the CPU 301 acquires, from the information sent in step S611 illustrated in FIG. 6, sheet information set in each sheet feeding stage and information indicating whether the corresponding feeding stage can be automatically drawn out when one of the sheet feeding stage open buttons 420 to 427 is pressed. In step S505, the CPU 301 creates information about the sheet feeding stage buttons 410 to 417 to be displayed on the top screen 400. In a case of creating the button information, if the corresponding sheet feeding stage can be automatically drawn out when the corresponding sheet feeding stage open button is pressed, the sheet feeding stage open buttons 420 to 427 are created and displayed on the sheet feeding stage buttons 410 to 417, respectively.

Figure 6:
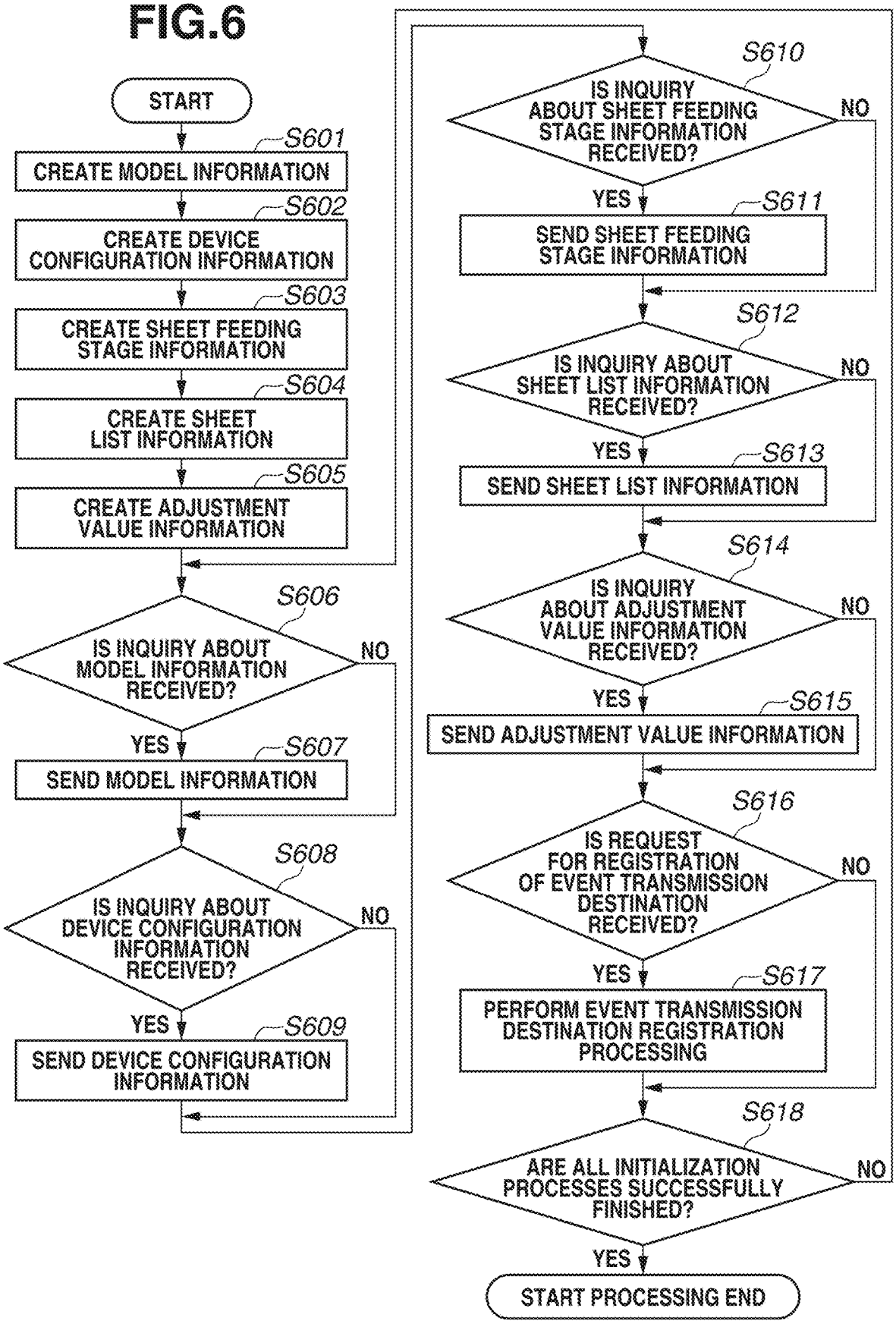
FIG. 6 is a flowchart illustrating an example of initialization processing for the image forming apparatus according to the first exemplary embodiment.

In step S506, the CPU 301 communicates with the image forming apparatus 103 and acquires sheet list information sent from the image forming apparatus 103 in step S613 illustrated in FIG. 6. In step S507, the CPU 301 creates information about a sheet list screen 1300 to be displayed on the top screen 400. Each piece of sheet information on the sheet list screen 1300 includes information indicating whether a setting for sheets to be fed to each sheet feeding stage of the image forming apparatus 103 can be made. Next, the processing proceeds to step S508. In step S508, the CPU 301 communicates with the image forming apparatus 103 and acquires adjustment values for each adjustment from the information sent in step S615 illustrated in FIG. 6 so that the acquired adjustment values can be used to display adjustment value information on the sheet list screen 1300. In step S509, the CPU 301 creates a character string to be displayed as the sheet information based on the adjustment values acquired in step S508. In this step, if the adjustment values are not changed from default values, "no adjustment" is displayed, and if the adjustment values are changed from default values, "adjust" is displayed. In step S510, the CPU 301 creates the top screen 400 based on the device configuration information about the image forming apparatus 103 acquired in steps S501 and S502, the sheet feeding stage button information created in step S505, the sheet list information created in step S507, and the adjustment value information created in step S509. In step S511, the CPU 301 registers, in the print control device 102, a transmission destination for change notification event processing to notify a change when the sheet feeding stage information and sheet information about the image forming apparatus 103 are changed for the image forming apparatus 103. If the registration is successful, processing for waiting for a change notification event is performed. When the processing for waiting for the change notification event is carried out, the start processing ends.

The processing illustrated in FIG. 5 described above is an operation to be performed when the sheet management application is activated. However, the sheet feeding stage information, sheet list information, adjustment values, and other information of the image forming apparatus 103 may be changed, as needed, while the sheet management application is used. Thus, updating of each information in association with communication between the sheet management application and the image forming apparatus 103 is also executed by the sheet management application, as needed. This updating is carried out regardless of a location in the image forming apparatus 103. It is assumed that information is synchronized between the sheet management application and the image forming apparatus 103.

FIG. 6 is a flowchart illustrating initialization processing for the image forming apparatus 103 according to the first exemplary embodiment. The processing illustrated in the flowchart is achieved by the CPU 201 executing the programs loaded into the RAM 202 as described above.

In step S601, the CPU 201 acquires model information about the image forming apparatus 103 from the external storage device 211, and creates the information as requestable data. In step S602, the CPU 201 acquires information about the configuration of each device connected to the image forming apparatus 103 from the external storage device 211, and creates the information as requestable data. In step S603, the CPU 201 acquires sheet feeding stage information about the image forming apparatus 103 from the external storage device 211, and creates the information as requestable data. In step S604, the CPU 201 acquires sheet list information about the image forming apparatus 103 from the external storage device 211, and creates the information as requestable data. In step S605, the CPU 201 acquires adjustment value information about the image forming apparatus 103 from the external storage device 211, and creates the information as requestable data. The processing for acquiring the adjustment value information is executed on all items that can be adjusted by the image forming apparatus 103.

In step S606, the CPU 201 determines whether an inquiry about model information has been received from the print control device 102. If the inquiry about the model information created in step S501 illustrated in FIG. 5 is received (YES in step S606), the processing proceeds to step S607. In step S607, the CPU 201 sends back the model information created in step S601 to the print control device 102, and then the processing proceeds to step S608. Even if the inquiry about the model information has not been received in step S606 (NO in step S606), the processing proceeds to step S608.

In step S608, the CPU 201 determines whether an inquiry about device configuration information has been received from the print control device 102. If the inquiry about the device configuration information created in step S502 illustrated in FIG. 5 is received (YES in step S608), the processing proceeds to step S609. In step S609, the CPU 201 sends back the device configuration information created in step S602 to the print control device 102, and then the processing proceeds to step S610. Even if the inquiry about the device configuration information has not been received (NO in step S608), the processing proceeds to step S610.

In step S610, the CPU 201 determines whether an inquiry about sheet feeding stage information has been received from the print control device 102. If the inquiry about the sheet feeding stage information created in steps S503 and S504 illustrated in FIG. 5 is received (YES in step S610), the processing proceeds to step S611. In step S611, the CPU 201 sends back the sheet feeding stage information created in step S603 to the print control device 102, and then the processing proceeds to step S612. Even if the inquiry about the sheet feeding stage information has not been received in step S610 (NO in step S610), the processing proceeds to step S612.

In step S612, the CPU 201 determines whether an inquiry about sheet list information has been received from the print control device 102. If the inquiry about the sheet list information created in steps S506 and S507 illustrated in FIG. 5 is received (YES in step S613), the processing proceeds to step S613. In step S613, the CPU 201 sends back the sheet list information created in step S604 to the print control device 102, and then the processing proceeds to step S614. Even if the inquiry about the sheet list information has not been received in step S612 (NO in step S612), the processing proceeds to step S614.

In step S614, the CPU 201 determines whether an inquiry about adjustment value information has been received from the print control device 102. If the inquiry about the adjustment value information created in step S508 illustrated in FIG. 5 is received (YES in step S614), the processing proceeds to step S615. In step S615, the CPU 201 sends back the adjustment value information to the print control device 102, and then the processing proceeds to step S616. Even if the inquiry about the adjustment value information has not been received in step S614 (NO in step S614), the processing proceeds to step S616. In step S616, the CPU 201 determines whether a request for registering transmission destination information for transmitting an event has been received from the print control device 102 when the state of the image forming apparatus 103 is changed. If the request for registering the transmission destination information is received (YES in step S616), the processing proceeds to step S617. In step S617, the CPU 201 adds the print control device 102 as an event transmission destination, and then the processing proceeds to step S618. Even if the request for registering the event transmission destination has not been received in step S616 (NO in step S616), the processing proceeds to step S618. In step S618, the CPU 201 determines whether all the processes performed in steps S606, S608, S610, S612, S614, and S616 are successfully finished. If all the processes are successfully finished (YES in step S618), the CPU 201 determines that the initialization processing is finished and terminates the processing. If not all the processes are successfully finished (NO in step S618), the processing returns to step S606.

The sheet feeding unit 116 according to the first exemplary embodiment is an example of a sheet feeding stage. The configuration of the sheet feeding stage 116 is not particularly limited, and sheet feeding stages of other mechanisms, such as an inserter, and a manual feed tray, may also be used.

Referring again to FIG. 4, for example, when the sheet feeding stage button 410 corresponding to a sheet feeding stage 1 is pointed by, for example, the pointing device 115, the sheet setting screen for the sheet feeding stage 1 is displayed, so that the setting for sheets to be fed to the sheet feeding stage 1 can be made and the setting value for each set sheet can be changed. The other sheet feeding stage buttons 411 to 417 have same structures as the structure of the sheet feeding stage button 410, and thus the description thereof is omitted. Although not described in detail in the present exemplary embodiment, examples of the sheet feeding stages include any type of stages, such as an inserter, and a manual feed tray. In the following description, a case where the pointing device 115 or the like is used to press a button while an application is operated is omitted. However, an input device, such as the pointing device 115, is used during the operation.

FIG. 7 illustrates an example of the sheet setting management table 700 included in the print control device 102 according to the first exemplary embodiment.

In the sheet setting management table 700, the following information is registered in association with a sheet identification (ID) for identifying each sheet: size information, such as the name, basis weight, size, width, and height of each sheet, surface properties, and setting values for a plurality of adjustment items. Examples of the adjustment items include a sheet conveyance speed of a first fixing portion, a sheet conveyance speed of a second fixing portion, a magnitude of a transfer voltage, and an adjustable image position. However, the adjustment items are not limited to these examples. In this system, all of the adjustment items or some (including one adjustment item) can be adjusted using an absolute adjustment value or a relative adjustment value. The adjustments for these adjustment items are collectively referred to as adjustment of values corresponding to adjustment items.

The sheet management program 353 can perform sheet information processing of editing, adding, deleting, and searching on the sheet setting management table 700. The sheet setting management table 700 is used for managing sheet information for each sheet ID, and is stored in the external storage device 309 which is a nonvolatile area. Instead of storing the sheet setting management table 700 in the external storage device 309, the sheet setting management table 700 may be stored in the external storage device 211 of the image forming apparatus 103, and the print control device 102 may acquire the sheet setting management table 700 from the image forming apparatus 103 and store the sheet setting management table 700 in the RAM 302 during program execution. The sheet feeding stage management program 354 communicates with the image forming apparatus 103 to manage the acquired sheet feeding stage information.

Figure 8:
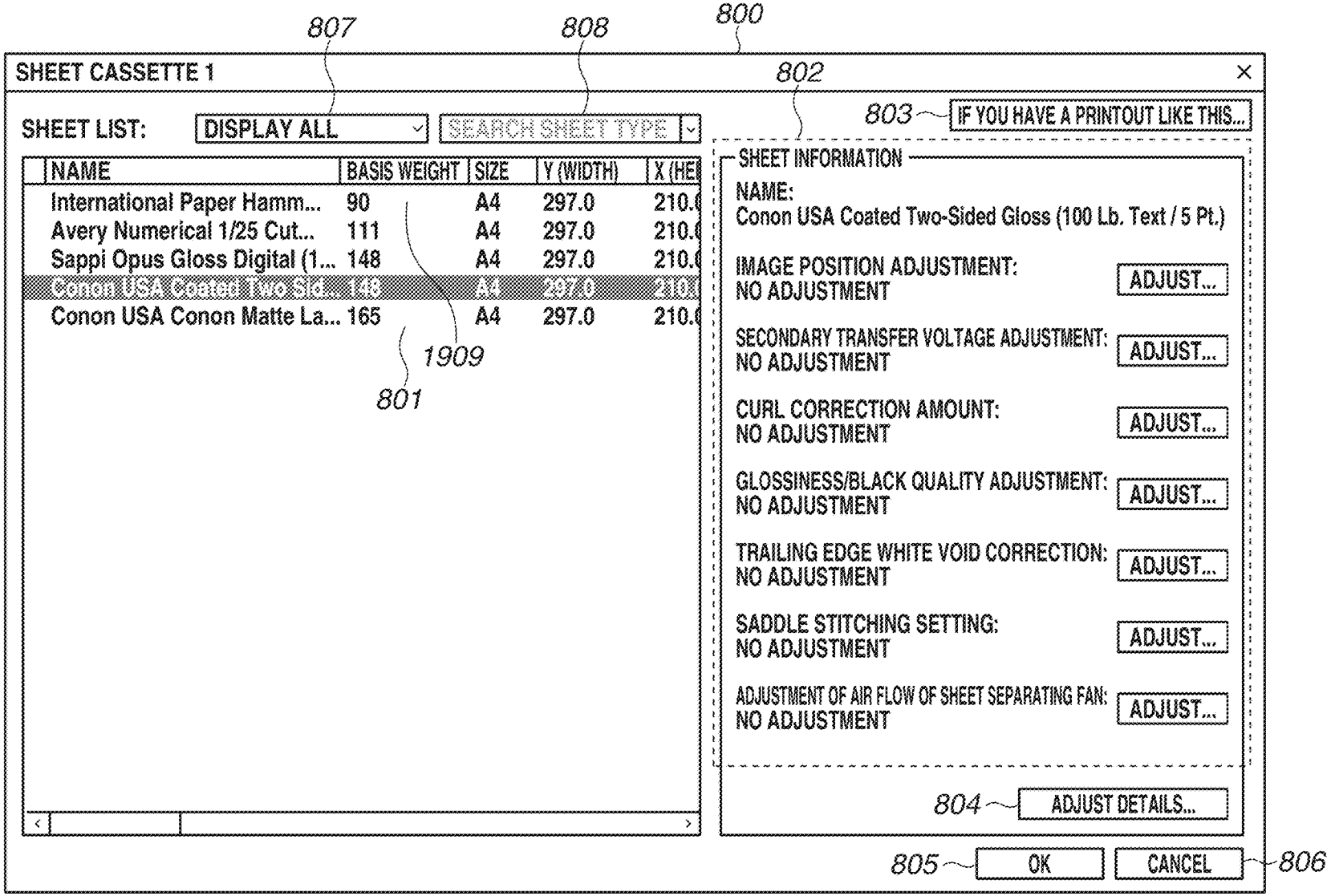
FIG. 8 illustrates an example of a sheet feeding stage screen to be displayed when a sheet feeding stage button on the top screen is pressed in the first exemplary embodiment.

FIG. 8 illustrates an example of a sheet feeding stage screen to be displayed when any one of the sheet feeding stage buttons 410 to 417 on the top screen 400 is pressed in the first exemplary embodiment.

A sheet feeding stage screen 800 is rendered in the video memory based on an instruction from the CPU 301. The image data rendered in the video memory is output as a video signal to the display unit 111, and the sheet feeding stage screen 800 is displayed. The sheet feeding stage screen 800 includes a sheet list display area 801 and a sheet information display area 802. Further, the sheet feeding stage screen 800 includes a button 803 for displaying an image defect list screen illustrated in FIG. 9, a button 804 for displaying a setting screen for other sheet information (not displayed), an OK button 805, and a cancel button 806. The sheet feeding stage screen 800 also includes a pull-down menu 807 for selecting a sheet list display method, and a sheet search input area 808.

The sheet list display area 801 is an area for displaying a sheet list. A sheet type is displayed in a column direction, and sheet information, such as an attribute of each sheet, is displayed in a row direction. In this example, a selected sheet type is highlighted to indicate which one of the sheet types is selected. When the sheet feeding stage screen 800 is displayed, the sheet that is set for the sheet feeding stage is selected on the sheet list display area 801. When a sheet is selected from the sheet list display area 801, information about the selected sheet is displayed in the sheet information display area 802. When another sheet is selected in the sheet list display area 801 and the OK button 805 is pressed, the controller 300 makes a sheet setting for the image forming apparatus 103. When another sheet is selected in the sheet list display area 801 and the cancel button 806 is pressed, the controller 300 closes the sheet setting screen without making a sheet setting for the image forming apparatus 103.

Next, each item included in the sheet information display area 802 will be described. The first exemplary embodiment illustrates an example where only the sheet information frequently used by the user is displayed to improve the user-friendliness. Specifically, a sheet name, and various adjustment items are displayed; examples of the various adjustment items include image position adjustment, secondary transfer voltage adjustment, curl correction amount, glossiness/black quality adjustment, trailing edge white void correction, saddle stitching setting, and adjustment of air flow of a sheet separating fan. The sheet information display area 802 displays information indicating whether the currently selected sheet name and various adjustment values are changed from initial values set in the image forming apparatus 103. If the sheet name and various adjustment values are not changed, "no adjustment" is displayed. If the sheet name and various adjustment values are changed, "adjust" is displayed. As for an item that can be adjusted from the print control device 102, an adjustment button is displayed to display the corresponding adjustment screen.

The "IF YOU HAVE A PRINTOUT LIKE THIS" button 803 is a button for displaying the image defect list screen 900 described below. If an image defect occurs in a user environment and the user does not know how to deal with the defect, the user presses the button 803.

The detailed adjustment button 804 is pressed to check information that is not displayed in the sheet information display area 802 and to change settings.

The pull-down menu 807 for selecting the sheet list display method displays options for filtering and displaying sheets to be displayed in the sheet list display area 801.

The sheet search input area 808 is an area for inputting a keyword used for an operator to search a desired sheet type from among the sheet types displayed in the sheet list display area 801. In the search input area 808, an incremental search is available, and the search is automatically executed every time a character is input.

Figure 9:
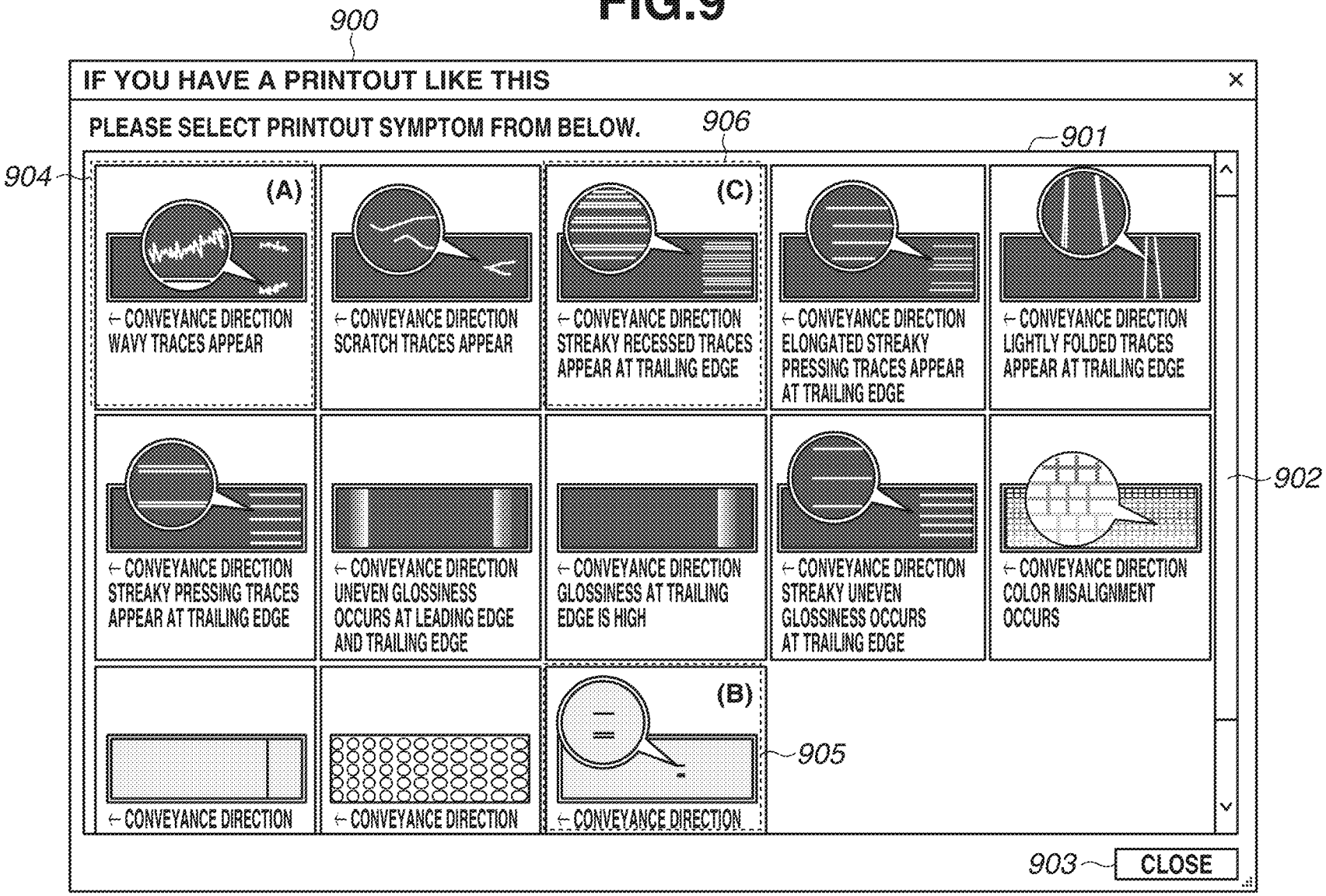
FIG. 9 illustrates an example of an image defect list screen to be displayed when an "IF YOU HAVE A PRINT-OUT LIKE THIS" button on the sheet feeding stage screen is pressed in the first exemplary embodiment.

FIG. 9 illustrates an example of an image defect list screen is displayed when the "IF YOU HAVE A PRINTOUT LIKE THIS" button 803 on the sheet feeding stage screen 800 is pressed.

The image defect list screen 900 is rendered in the video memory based on an instruction from the CPU 301. The image data rendered in the video memory is output as a video signal to the display unit 111, and the image defect list screen 900 is displayed. The image defect list screen 900 includes an image defect list display area 901, a slider bar 902, and a close button 903.

In the image defect list display area 901, samples of image defects that may occur in the image forming apparatus 103 and explanations about the samples are displayed. Each of areas (e.g., image defect sample buttons 904, 905 and 906) in which a sample of an image defect and an explanation about the sample are displayed is a button. For example, when the image defect sample button 904 is pressed, an adjustment screen for improving the symptom corresponding to the image defect sample button 904 is displayed. The adjustment screen displayed when any one of the image defect sample buttons is pressed will be described with reference to FIGS. 10A to 10C.

Since the image defect list display area 901 has a limited information display area, the entire area can be browsed by operating the slider bar 902.

Thus, the configuration for visualizing and selectively displaying samples of image defects that may occur in the image forming apparatus 103 enables selection of a sample image similar to the image defect occurring in the user environment and enables the user to easily reach the adjustment screen for improving the symptom.

Since the symptom related to the image defect varies depending on the type of the image forming apparatus 103, the image samples displayed in the image defect list can be changed depending on the model of the image forming apparatus 103 connected to the sheet management application.

Figure 10A:
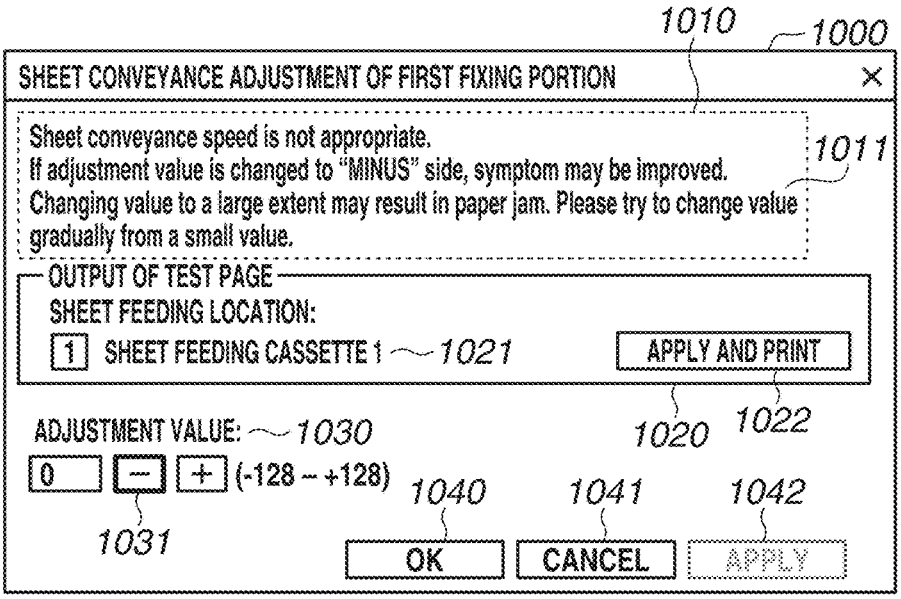
FIGS. 10A to 10C each illustrate an example of an adjustment screen to be displayed when an image defect sample button on the image defect list screen is pressed in the first exemplary embodiment.
Figure 10B:
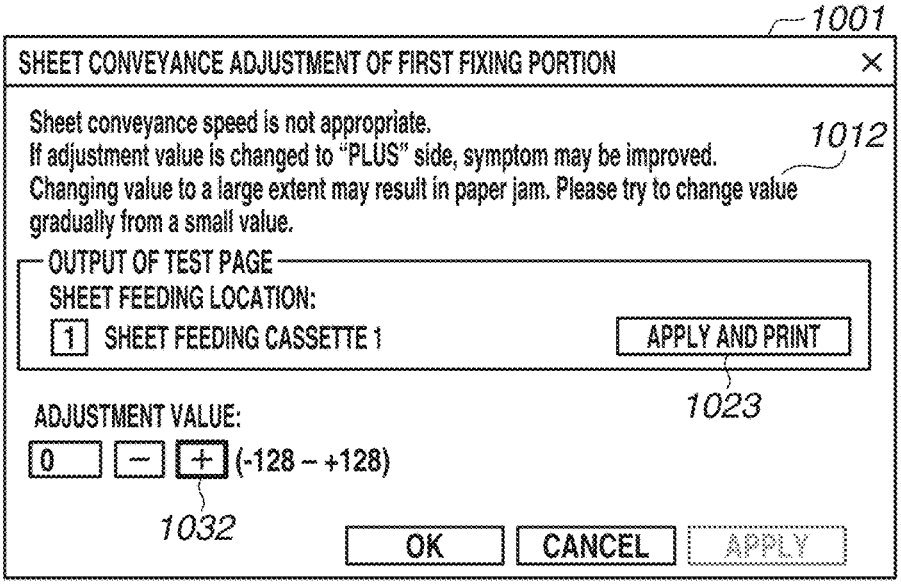
Figure 10C:
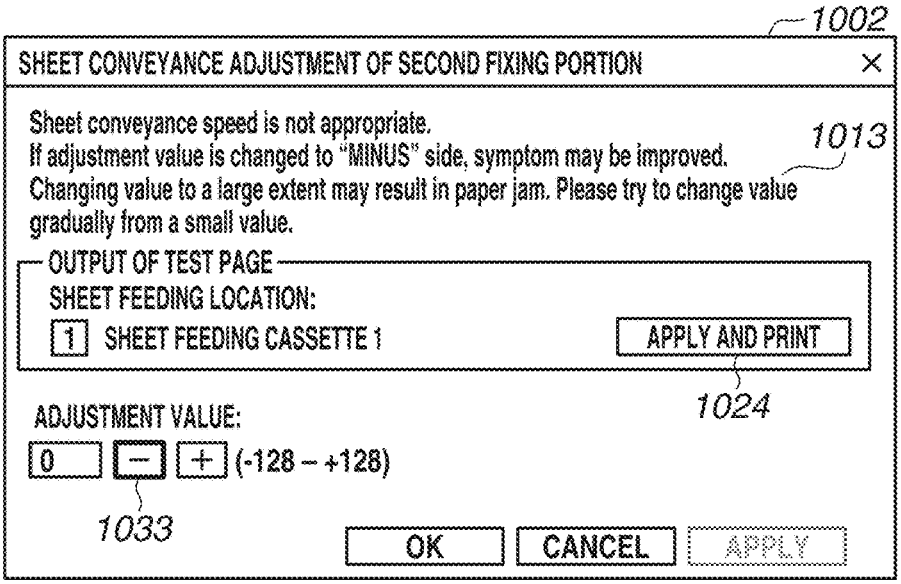

FIGS. 10A, 10B and 10C each illustrate an example of an adjustment screen to be displayed when any one of the image defect sample buttons 904, 905 and 906 is pressed. In this example, when the image defect sample button 904 is pressed, a sheet conveyance adjustment screen 1000 for the first fixing portion illustrated in FIG. 10A is displayed. When the image defect sample button 905 is pressed, a sheet conveyance adjustment screen 1001 for the first fixing portion illustrated in FIG. 10B is displayed. When the image defect sample button 906 is pressed, a sheet conveyance adjustment screen 1002 for the first fixing portion illustrated in FIG. 10C is displayed.

The UI configuration of each of the adjustment screens illustrated in FIGS. 10A to 10C will now be described.

Various adjustment screens illustrated in FIGS. 10A, 10B and 10C are each composed of a descriptive text display area 1010, a test page output function 1020, an adjustment function 1030, an OK button 1040, a cancel button 1041, and an apply button 1042.

The descriptive text display area 1010 is an area in which the adjustment method for each adjustment is explained. The user performs various adjustment processes while reading the explanation. The test page output function 1020 includes a button 1021 for displaying a location where sheets are fed, and an "apply and print" button 1022 for outputting a test page. When the "apply and print" button 1022 is clicked, the controller 300 writes the current setting values into the sheet setting management table 700, generates an optimum test chart for adjustment, and outputs the generated test chart. The test chart may be generated by the controller 200 of the image forming apparatus 103, or may be generated by the controller 300 of the print control device 102. The adjustment function 1030 includes a control function for changing the adjustment value for each adjustment item related to sheets. The adjustment function 1030 include, for example, a text box for directly receiving an input of an adjustment value, and a plus/minus button for increasing or decreasing the adjustment value. In addition, an adjustable range, such as (−128-+128), may be displayed. In the control function for changing the adjustment value for each adjustment item related to sheets, the adjustment may be carried out using not only the text box and the plus/minus button, but also, for example, a slider bar or a radio button. Further, a plurality of adjustment items may be displayed on one adjustment screen and adjustments for the plurality of adjustment items may be performed at once.

When the OK button 1040 or the apply button 1042 is clicked, the controller 300 writes the current sheet information into the sheet setting management table 700. The controller 300 then transmits a sheet setting instruction for registering the information about the sheet setting management table 700 corresponding to the selected sheet for the image forming apparatus 103 in the corresponding sheet feeding stage. On the other hand, when the cancel button 1041 is clicked, the controller 300 closes this dialog without editing the information about the sheet that has been set when the adjustment screen 1000 is displayed. The apply button 1042 may be grayed out to prevent the apply button 1042 from being pressed before the adjustment value is changed by the adjustment function 1030. In the present exemplary embodiment, the adjustment screens illustrated in FIGS. 10A to 10C are displayed from the sheet feeding stage screen 800, and thus the sheet feeding stage to be adjusted is uniquely determined. While the present exemplary embodiment illustrates an example where "sheet cassette 1" is displayed on the button 1021, the display is not limited to this example. For example, when a sheet is selected from the sheet list screen 430 and the adjustment screen is opened, the sheet feeding stages to which the sheet is fed may be displayed in a list and the user may select the sheet feeding stage to be adjusted.

Next, features of each adjustment screen according to the present exemplary embodiment will be described.

FIGS. 10A and 10B each illustrate an adjustment screen for sheet conveyance adjustment of the first fixing portion. However, a control operation to be performed when a display item or a button on an adjustment dialog is pressed varies depending on which one of the image detect sample buttons is pressed. An example of the control operation will be described below.

Differences between messages to be displayed in the descriptive text display area 1010 will now be described.

On the adjustment screen of FIG. 10A to be displayed when the image defect sample button 904 is pressed, a message indicating that the symptom is improved when the adjustment value is changed to the "minus" side is displayed as indicated in an area 1011. On the other hand, on the adjustment screen of FIG. 10B to be displayed when the image defect sample button 905 is pressed, a message indicating that the symptom is improved when the adjustment value is changed to the "plus" side is displayed as indicated in an area 1012. FIGS. 10A to 10C each illustrate an example of a display for adjustment of the value related to the adjustment item and a display of a message for prompting the user to change the value related to the adjustment item on the same screen.

Next, a difference in the test page output function 1020 will be described.

In a case of the adjustment screen of FIG. 10A to be displayed when the image defect sample button 904 is pressed, the "apply and print" button 1022 is pressed so that the symptom displayed on the image defect sample button 904 can be improved. Accordingly, for example, a printer prints out a solid image with a mixture of cyan 255 and magenta 255. On the other hand, in a case of the adjustment screen of FIG. 10B to be displayed when the image defect sample button 905 is pressed, the printer outputs the following image when the "apply and print button" 1023 is pressed. That is, the printer prints out a solid image with a single color of, for example, black 128 so that the symptom displayed on the image defect sample button 905 can be improved. This is an example of processing for displaying an instruction reception portion as a user interface for receiving a chart output instruction. The output instruction portion according to the present exemplary embodiment is not limited to this example. For example, a radio button or a checkbox for indicating whether to apply or not may be disposed, or a print button may be separately provided.

Next, a difference in a default focus position between the adjustment screens will be described. On the adjustment screen of FIG. 10A, the default focus position is located on a minus button 1031. This is because, while the symptom exists, it is highly likely that the symptom can be improved when the adjustment value is changed to the "minus" side. In contrast, on the adjustment screen of FIG. 10B, the default focus position is located on a plus button 1032. This is because, while the symptom exists, it is highly likely that the symptom can be improved when the adjustment value is changed to the "plus" side.

As described above, FIGS. 10A and 10B each illustrate an adjustment screen for sheet conveyance adjustment of the first fixing portion. The display item on the adjustment dialog or control operation to be performed when a button is pressed varies depending on which one of the image defect sample buttons is pressed.

FIG. 10C illustrates an adjustment screen to be displayed when the image defect sample button 906 is pressed. Similar to FIGS. 10A and 10B, an optimum screen for improving the symptom is generated. Since the symptom can be improved by changing the sheet conveyance adjustment of the second fixing portion, a screen for sheet conveyance adjustment of the second fixing portion is displayed. In addition, it is highly likely that the symptom can be improved by changing the adjustment value to the "minus" side. Thus, a message 1013 is displayed, and a default focus position is set to the minus button 1033 so that the user can easily access the minus button 1033. When an "apply and print" button 1024 is pressed, the printer prints out a solid image with a mixture of cyan 255 and magenta 255, which is similar to FIG. 10A.

As described above, an optimum adjustment screen for improving the symptom is displayed depending on the pressed image defect sample button. The user thereby can easily reach the adjustment screen and easily perform the sheets related adjustment only by following the operation displayed on the adjustment screen.

FIG. 11 illustrates an example of an adjustment screen management table to be referred to when the adjustment screen is generated based on the selected image defect sample. The UI control program 352 can refer to an adjustment screen management table 1100. The adjustment screen management table 1100 manages information for generating the adjustment screen for each image defect sample button. The adjustment screen management table 1100 is stored in the external storage device 309 which is a nonvolatile area. Instead of storing the adjustment screen management table 1100 in the external storage device 309, the adjustment screen management table 1100 may be stored in the external storage device 211 of the image forming apparatus 103. The print control device 102 may acquire the sheet setting management table 700 from the image forming apparatus 103. The print control device 102 may also store the sheet setting management table 700 in the RAM 320 during execution of the program.

The adjustment screen management table 1100 includes information, such as an image ID 1101, an adjustment item 1102, a message 1103, a chart type 1104, and a number of output sheets 1105.

The image ID 1101 is an ID to be assigned to each image defect sample button. With this image ID 1101, it is possible to identify which one of the image defect sample buttons has been pressed.

The adjustment item ID 1102 is an adjustment item for improving the symptom when the image defect associated with the image ID occurs. For example, the adjustment item ID 1102 corresponds to the items, such as "sheet conveyance of first fixing portion", and "conveyance adjustment of second fixing portion", as described above with regard to the adjustment screens illustrated in FIGS. 10A to 10C. The message 1103 is a message to be displayed in the descriptive text display area 1010 illustrated in FIG. 10A. The chart type 1104 indicates a type of a chart to be generated and output when the "apply and print" button of the test page output function 1020 is pressed.

For example, in the case of FIG. 10A described above, a solid image is printed with a mixture of cyan 255 and magenta 255, and in the case of FIG. 10B, a solid image is printed with a single color of black 128. In other words, FIGS. 10A and 10B illustrate different charts, which enable the user to easily check whether the image detect to be resolved has been resolved. The chart that enables the user to check whether the symptom related to the image detect can be improved is a chart used for the user to check whether the symptom corresponding to the selected image sample button has been improved. The above-described charts are examples of the chart to be output with at least one of a color and an image for checking the symptom. FIGS. 10A to 10C illustrate examples of the adjustment screen.

The number of output sheets 1105 indicates the number of output sheets of the chart. The number of output sheets 1105 is used to change the number of sheets of the chart to be output depending on the symptom. For example, if the symptom related to a certain image defect is not likely to occur on a first page of a printout but is likely to occur on a second page of the printout, the number of output sheets 1105 is set to "2". This is an example where the chart that enables the user to check whether the symptom has been improved is output as a page that enables the user to check whether the symptom corresponding to the selected display object has been improved. Specifically, in a case where it cannot be checked whether the symptom is improved on the first page, but it can be checked whether the symptom is improved on the second page, at least the second page is output. For example, in a case of printing 100 pages, if it is sufficient to print only the fifth page, only the fifth page may be printed automatically or on condition that checking is executed by the user.

The items held in the adjustment screen management table 1100 are not limited to the items described above. For example, when a printing mode is switched between one-sided printing and both-sided printing depending on the symptom, more items may be added to the adjustment screen management table 1100.

Figure 12:
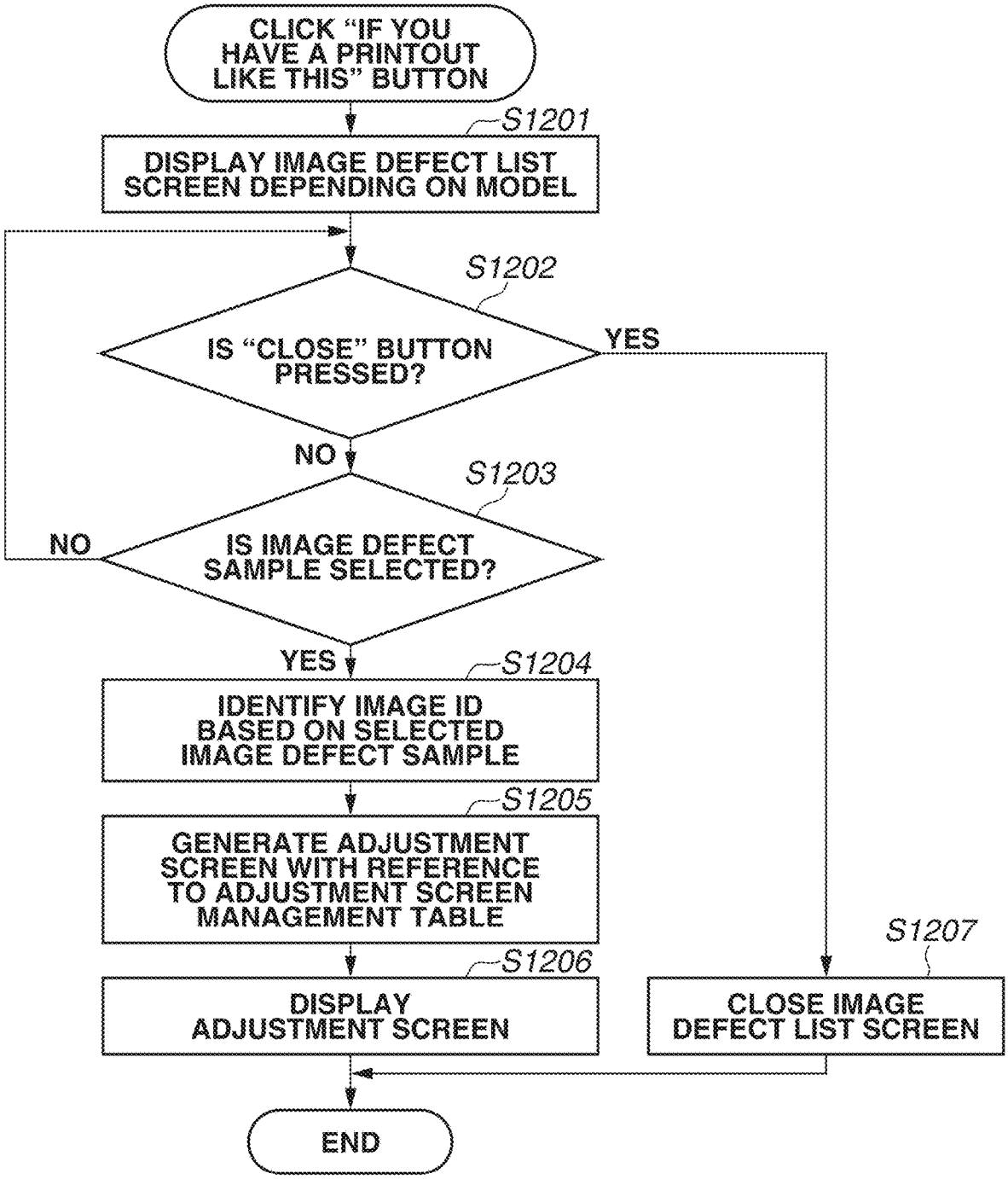
FIG. 12 is a flowchart illustrating an example of processing for generating the adjustment screen when the image defect sample button is pressed in the first exemplary embodiment.

FIG. 12 is a flowchart illustrating processing for generating the adjustment screen when the "IF YOU HAVE A PRINTOUT LIKE THIS" butt 803 illustrated in FIG. 8 is pressed and displaying the generated adjustment screen. The sheet management application according to the first exemplary embodiment is operated on the print control device 102. However, the sheet management application may also be operated on, for example, the client computer 101. The present exemplary embodiment illustrates an example where the sheet management application is executed by the print control device 102. The processing illustrated in this flowchart is achieved by the CPU 301 executing the programs loaded into the RAM 302 as described above.

In step S1201, the model information determined in step S501 of the sheet management application start processing illustrated in FIG. 5 is used to display the image defect list screen 900 depending on the model of the connected image forming apparatus 103. The image defect list screen 900 is continuously displayed until the "close" button 903 is pressed in step S1202 or any one of the image defect samples is selected in step S1203. If the "close" button 903 is pressed in step S1202 (YES in step S1202), the processing proceeds to step S1207. In step S1207, the image defective list screen 900 is closed and the processing in this flowchart is terminated. If any one of the image defect samples is selected in step S1203 (YES in step S1203), the processing proceeds to step S1204. When the image ID 1101 is preliminarily assigned to each image defect sample button displayed in the image defect list display area 901, which one of the image defect sample buttons is pressed can be identified in step S1204.

In step S1205, information about the adjustment item 102, the message 1103, the chart type 1104, and the number of output sheets 1105 is acquired from the identified image ID 1101 with reference to the adjustment screen management table 1100. In step S1205, the information acquired in step S1204 is used to generate the adjustment screen corresponding to the selected image defect sample. In step S1206, the generated adjustment screen is displayed.

As the adjustment screen, for example, at least one of the screens illustrated in FIGS. 10A to 10C described above may be displayed.

An example of the image forming apparatus according to the present exemplary embodiment is the image forming apparatus 103. The image forming apparatus 103 controls processing for displaying a plurality of display objects respectively corresponding to symptoms related to image detect that have occurred or may occur in the image forming apparatus 103 on a display unit for displaying the display objects. An example of the display unit is the operation panel 105 of the image forming apparatus 103, or the display unit 111 of the print control device 102 communicably connected to the image forming apparatus 103. These display units are hereinafter collectively referred to simply as a display unit. Examples of the display objects include sample images displayed on, for example, the image defect sample buttons 904 and 906 illustrated in FIG. 9. Each display object may be represented only by a character string (with no sample image) as illustrated below the image defect sample button 904. In this case, a sample image that can be easily identified by the user from a printout as illustrated in FIG. 9 can be used.

In the following description, a sample image may be replaced by a predetermined character string.

One sample can be selected from among a plurality of sample images displayed on the display unit. A plurality of character strings may be displayed and the CPU 301 may select a character string indicating one image defect from among the plurality of character strings. The CPU 301 may display, on the display unit, a display screen for adjusting a value corresponding to a predetermined adjustment item for improving the symptom corresponding to the selected sample image. For example, the screens illustrated in FIGS. 10A to 10C are used for the display screen. For example, when the user selects the image defect sample button 904 illustrated in FIG. 9 with a mouse, and sends an instruction to the CPU 301, the screen illustrated in FIG. 10A can be displayed. Similarly, the screen illustrated in FIG. 10B can be displayed when the image defect sample button 906 illustrated in FIG. 9 is selected. The screen illustrated in FIG. 10C can be displayed when the image defect sample button 906 illustrated in FIG. 9 is selected.

A display for adjusting the value corresponding to the predetermined adjustment item to solve the symptom corresponding to the sample image will now be described in detail. For example, FIG. 9A illustrates an example of a defect in the printed image in which wavy traces appear. An image "defect" is determined to be defective or not depending on a threshold value, and thus the image can also be considered to have defective possibility. These cases are collectively referred to as the "symptom" related to an image defect or an image that can be defective. In this case, the message in the descriptive text display area 1010 is displayed to solve the symptom related to the image defect A. The term "symptom" used herein means a phenomenon in which the apparatus seems to be influenced to some extent. The sheet conveyance of the first fixing portion is one of the adjustment items, and the adjustment value for the adjustment item can be input in the form of "+" or "−" from a reference value. The descriptive text display area 1010 displays the message indicating that the image defect is improved by changing the adjustment value to the "minus" side. Instead of inputting the adjustment value, the reference value may be increased or decreased to another value. In this case, a predetermined value is set as the reference value, and it is assumed that a message indicating that the predetermined value is increased or decreased is displayed. Although display examples for adjustment are described above using different methods, these are examples of the display for adjusting the value corresponding to the predetermined adjustment item improve the symptom corresponding to the sample image. Instead of directly displaying the message in the descriptive text display area 1010, the messages displayed in the areas 1010, 1012, and 1013 illustrated in FIGS. 10A to 10C may be omitted. For example, when the adjustment value is input to the "plus" button, the color of the value can be changed to red, and when the adjustment value is input to the "minus" button, the color of the value can be changed to blue. This can be considered as an example of the display for adjustment of the value corresponding to the predetermined adjustment item. Red and blue are color examples of the adjustment value. It is implied that red is used to prohibit the use of the item and blue is used to indicate that it is desirable to resolve the image defect. In other words, any method can be used, as long as it can be recognized how to adjust the value to improve the symptom corresponding to the image defect sample button 904 illustrated in FIG. 9 on the screen for adjusting the value corresponding to the adjustment item using an absolute value or a relative value.

The CPU 301 may control the image forming apparatus 103 based on the value corresponding to the adjustment item that has been adjusted based on the operation related to the display for adjusting the value corresponding to the predetermined adjustment item displayed on the display unit 111. For example, the adjustment value input with the pointing device 115 is transmitted to the LAN 110 under the control of the CPU 301. Then, the adjustment value is received by the controller 200 via the control cable 108. The adjustment value may be transmitted to the print engine 210 and may be controlled such that the sheet conveyance speed of the first fixing portion can be increased or decreased under the control of the CPU 201.

The present exemplary embodiment can also be implemented as processing to be executed only in the image forming apparatus 103. In this case, the operation of the CPU 301 described above may be performed by the CPU 201. The adjustment screens illustrated in FIGS. 8 to 10C can also be displayed on the operation panel 105. The objects illustrated in FIG. 9 can be selected through an input on the operation panel 105. The operation panel 105 may be implemented by an input from a touch panel. Further, the operation panel 105 may include hardware keys, such as a numeric keypad, and various function hardware keys, and values may be input via the hardware keys. After a desired sample image or the like is selected on the operation panel 105, the corresponding one of the screens illustrated in FIGS. 10A to 10C is displayed. For example, the adjustment value can also be input via the operation panel 105 on the screen displayed on the operation panel 105. The adjustment value input on the operation panel 105 is transmitted to the print engine 210 and controlled so that, for example, the sheet conveyance speed of the first fixing portion can be increased or decreased, under the control of the CPU 201.

The flow of the setting value for the adjustment item is similar to that when the sheet conveyance speed of the second fixing portion is increased or decreased as illustrated in FIG. 10C and the OK button is pressed to continue the setting.

The processing for adjustment of each of the transfer voltage, the image position adjustment, and the like is performed in the same manner as described above. The first fixing portion and the second fixing portion are built in the printer engine 210. An adjustment value for the transfer voltage and an adjustment value for the image position adjustment are used for controlling the printer engine 210.

The CPU 301 and the CPU 201 are examples of a computer for executing various print control methods according to the present exemplary embodiment. As described above, according to the first exemplary embodiment, a list of image defects that may occur in the image forming apparatus 103 is selectively displayed with sample images, and an adjustment screen for prompting the user to perform an operation for resolving the selected image defect is presented to the user. This configuration enables the user to easily reach the adjustment screen for resolving the image defect occurring in the image forming apparatus 103 and to easily perform adjustment processing related to sheets only by performing the operation displayed on the adjustment screen.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-158667, filed Aug. 30, 2019, which is hereby incorporated by reference herein in its entirety.

What is claimed is:

1. A system, comprising:

a display that displays a plurality of objects respectively indicating a plurality of defects potentially generated on an image printed by a printer;

a storage that stores information indicating a setting item to be adjusted to remove a defect indicated by each of the plurality of objects;

a user interface that selects an object from among the plurality of objects displayed by the display; and a controller that specifies, based on the object selected by the user interface and the information stored in the storage, a setting item to be adjusted to remove a defect indicated by the object selected by the user interface and that causes the display to display a screen for receiving a value of the specified setting item, wherein, in a case where the object selected by the user interface is a first object indicating a streaky trace, the controller further causes the display to display a first message for prompting a user to increase a value of a sheet conveyance speed, and wherein, in a case where the object selected by the user interface is a second object indicating a wavy trace, the controller further causes the display to display a second message for prompting the user to decrease a value of the sheet conveyance speed.

2. The system according to claim 1, wherein the controller causes the printer to perform printing based on the received value.

3. The system according to claim 1, wherein the user interface further receives the value.

4. The system according to claim 1, wherein at least one of the plurality of objects indicates uneven glossiness on the image.

5. The system according to claim 1, wherein the system is to be able to communicate with the printer.

6. A system control method comprising:

displaying a plurality of objects respectively indicating a plurality of defects potentially generated on an image printed by a printer;

selecting an object from among the plurality of objects; and specifying, based on the selected object and stored information indicating a setting item regarding a component of the printer to be adjusted to remove a defect indicated by each of the plurality of objects, a setting item to be adjusted to remove a defect indicated by the selected object;

displaying a screen for receiving a value of the specified setting item;

displaying, in a case where the selected object is a first object indicating a streaky trace, a first message for prompting a user to increase a value of a sheet conveyance speed; and displaying, in a case where the selected object is a second object indicating a wavy trace, a second message for prompting the user to decrease a value of the sheet conveyance speed.

7. A non-transitory computer-readable storage medium storing computer executable instructions for causing a computer to execute a system control method, the system control method comprising:

displaying a plurality of objects respectively indicating a plurality of defects potentially generated on an image printed by a printer;

selecting an object from among the plurality of objects;

specifying, based on the selected object and stored information indicating a setting item regarding a component of the printer to be adjusted to remove a defect indicated by each of the plurality of objects, a setting item to be adjusted to remove a defect indicated by the selected object;

displaying a screen for receiving a value of the specified setting item;

displaying, in a case where the selected object is a first object indicating a streaky trace, a first message for prompting a user to increase a value of a sheet conveyance speed; and displaying, in a case where the selected object is a second object indicating a wavy trace, a second message for prompting the user to decrease a value of the sheet conveyance speed.

* * * * *